US008583019B2

(12) United States Patent
Ishii et al.

(10) Patent No.: US 8,583,019 B2
(45) Date of Patent: Nov. 12, 2013

(54) FIXING DEVICE AND IMAGE FORMING APPARATUS INCORPORATING SAME

(75) Inventors: Kenji Ishii, Kanagawa (JP); Masaaki Yoshikawa, Tokyo (JP); Yoshiki Yamaguchi, Kanagawa (JP); Toshihiko Shimokawa, Kanagawa (JP); Naoki Iwaya, Tokyo (JP); Takahiro Imada, Kanagawa (JP); Yutaka Ikebuchi, Kanagawa (JP); Takamasa Hase, Kanagawa (JP); Tetsuo Tokuda, Kanagawa (JP); Hiroshi Yoshinaga, Chiba (JP); Kenichi Hasegawa, Kanagawa (JP); Ippei Fujimoto, Kanagawa (JP); Akira Shinshi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 429 days.

(21) Appl. No.: 13/024,736

(22) Filed: Feb. 10, 2011

(65) Prior Publication Data

US 2011/0217095 A1 Sep. 8, 2011

(30) Foreign Application Priority Data

Mar. 3, 2010 (JP) ..... 2010-046529

(51) Int. Cl.
*G03G 15/20* (2006.01)

(52) U.S. Cl.
USPC ..... 399/329; 219/216

(58) Field of Classification Search
USPC ..... 399/328, 329, 333; 219/216
See application file for complete search history.

(56) References Cited

U.S. PATENT DOCUMENTS

| | | | | |
|---|---|---|---|---|
| 6,001,440 | A | 12/1999 | Miyamoto et al. | |
| 7,869,753 | B2 | 1/2011 | Shinshi | |
| 8,437,675 | B2 * | 5/2013 | Ishii et al. | 399/333 |
| 8,447,220 | B2 * | 5/2013 | Yamaguchi et al. | 399/329 |

(Continued)

FOREIGN PATENT DOCUMENTS

| | | |
|---|---|---|
| CN | 1115433 A | 1/1996 |
| JP | 10-213984 | 8/1998 |

(Continued)

OTHER PUBLICATIONS

Extended Search Report issued Jun. 1, 2011 in Europe Application No. 11154438.3.

(Continued)

*Primary Examiner* — William J Royer
(74) *Attorney, Agent, or Firm* — Oblon, Spivak, McClelland, Maier & Neustadt, L.L.P.

(57) ABSTRACT

A fixing device includes an endless belt-shaped fixing member; a pressing member; a contact member provided inside a loop formed by the fixing member and pressed against the pressing member via the fixing member to form a nip between the pressing member and the fixing member, a laminated heater facing an inner circumferential face of the fixing member to heat the fixing member, connected to an external power source, and including a heat generation sheet that includes a heat-resistant resin in which conductive particles to receive electricity from the external power source and generate heat are unevenly dispersed throughout the heat-resistant resin to have a dispersal gradient of increasing particle dispersion density from an inner face toward an outer face of the heat generation sheet; and a heater support to support the laminated heater along the inner circumferential face of the fixing member.

9 Claims, 5 Drawing Sheets

(56) References Cited

U.S. PATENT DOCUMENTS

| | | | |
|---|---|---|---|
| 2003/0063931 | A1 | 4/2003 | Sanpei et al. |
| 2003/0183610 | A1 | 10/2003 | Okabayashi et al. |
| 2007/0292175 | A1 | 12/2007 | Shinshi |
| 2008/0112739 | A1 | 5/2008 | Shinshi |
| 2008/0175633 | A1 | 7/2008 | Shinshi |
| 2008/0298862 | A1 | 12/2008 | Shinshi |
| 2009/0311016 | A1 | 12/2009 | Shinshi |
| 2010/0092220 | A1 | 4/2010 | Hasegawa et al. |
| 2010/0092221 | A1 | 4/2010 | Shinshi et al. |
| 2010/0202809 | A1 | 8/2010 | Shinshi et al. |
| 2010/0290822 | A1 | 11/2010 | Hasegawa et al. |
| 2011/0026987 | A1 | 2/2011 | Hasegawa |
| 2011/0026988 | A1 | 2/2011 | Yoshikawa et al. |

FOREIGN PATENT DOCUMENTS

| | | |
|---|---|---|
| JP | 2884714 | 2/1999 |
| JP | 3298354 | 4/2002 |
| JP | 3592485 | 9/2004 |
| JP | 2007-334205 | 12/2007 |
| JP | 2008-146010 | 6/2008 |
| JP | 2008-158482 | 7/2008 |
| JP | 2008-216928 | 9/2008 |
| JP | 2009-3410 | 1/2009 |

OTHER PUBLICATIONS

Combined Chinese Office Action and Search Report issued Apr. 2, 2013, in Chinese Patent Application No. 201110042665.5 with English translation of category of cited documents.

U.S. Appl. No. 12/805,818, filed Aug. 20, 2010.
U.S. Appl. No. 12/876,589, filed Sep. 7, 2010, Yoshiki Yamaguchi et al.
U.S. Appl. No. 12/879,875, filed Sep. 10, 2010, Ippei Fujimoto et al.
U.S. Appl. No. 12/852,079, filed Aug. 6, 2010, Akira Shinshi et al.
U.S. Appl. No. 12/923,272, filed Sep. 13, 2010.
U.S. Appl. No. 12/881,862, filed Sep. 14, 2010, Takamasa Hase et al.
U.S. Appl. No. 12/888,980, filed Sep. 23, 2010, Yoshiki Yamaguchi et al.
U.S. Appl. No. 12/923,231, filed Sep. 10, 2010.
U.S. Appl. No. 12/923,176, filed Sep. 8, 2010.
U.S. Appl. No. 12/874,734, filed Sep. 2, 2010, Akira Shinshi et al.
U.S. Appl. No. 12/861,255, filed Aug. 23, 2010, Satoshi Ueno et al.
U.S. Appl. No. 12/881,547, filed Sep. 14, 2010, Naoki Iwaya et al.
U.S. Appl. No. 12/849,404, filed Aug. 3, 2010, Toshihiko Shimokawa et al.
U.S. Appl. No. 12/878,480, filed Sep. 9, 2010, Yoshiki Yamaguchi et al.
U.S. Appl. No. 12/880,327, filed Sep. 13, 2010, Ryota Yamashina et al.
U.S. Appl. No. 12/857,953, filed Aug. 17, 2010, Masaaki Yoshikawa et al.
U.S. Appl. No. 12/893,361, filed Sep. 29, 2010, Kenichi Hasegawa et al.
U.S. Appl. No. 12/878,557, filed Sep. 9, 2010, Akira Shinshi et al.
U.S. Appl. No. 12/946,276, filed Nov. 15, 2010, Yoshiki Yamaguchi et al.
U.S. Appl. No. 12/946,347, filed Nov. 15, 2010, Kenji Ishii et al.

* cited by examiner

FIXING DEVICE AND IMAGE FORMING APPARATUS INCORPORATING SAME

CROSS-REFERENCE TO RELATED APPLICATIONS

The present application is based on and claims priority to Japanese Patent Application No. 2010-046529, filed on Mar. 3, 2010, in the Japan Patent Office, which is hereby incorporated herein by reference in its entirety.

BACKGROUND OF THE INVENTION

1. Field of the Invention

Exemplary aspects of the present invention relate to a fixing device and an image forming apparatus, and more particularly, to a fixing device for fixing a toner image on a recording medium, and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may include an endless fixing belt formed into a loop and a resistant heat generator provided inside the loop formed by the fixing belt to heat the fixing belt, to shorten a warm-up time or a time to first print (hereinafter also "first print time"). Specifically, the resistant heat generator faces the inner circumferential surface of the fixing belt across a slight gap. A pressing roller presses against a contact member also provided inside the loop formed by the fixing belt via the fixing belt to form a nip between the fixing belt and the pressing roller through which the recording medium bearing the toner image passes. As the recording medium bearing the toner image passes through the nip, the fixing belt heated by the resistant heat generator and the pressing roller apply heat and pressure to the recording medium to fix the toner image on the recording medium.

With the above configuration, the slight gap provided between the resistant heat generator and the fixing belt prevents wear of the resistant heat generator and the fixing belt while at the same time providing the shortened warm-up time and the shortened first print time described above. Accordingly, even when the fixing belt rotates at a high speed, the resistant heat generator heats the fixing belt to a desired fixing temperature with reduced wear of the fixing belt and the resistant heat generator.

However, rotation and vibration of the pressing roller repeatedly applies mechanical stress to the resistant heat generator via the fixing belt, which bends the resistant heat generator. The repeated bending of the resistant heat generator causes fatigue failure and concomitant breakage or disconnection of the wiring of the resistant heat generator, resulting in faulty heating of the fixing belt.

Further, since the entire heat resistance generator generates heat, some of the heat generated in the heat resistance generator leaks to a portion on the opposite side of the fixing belt through an inner face (back face) of the heat resistance generator. Consequently, the heat resistance generator cannot heat the fixing belt effectively.

SUMMARY OF THE INVENTION

This specification describes below an improved fixing device. In one exemplary embodiment of the present invention, a fixing device includes an endless belt-shaped fixing member, a pressing member, a contact member, a laminated heater, and a generally cylindrical heater support. The endless belt-shaped fixing member rotates in a predetermined direction, formed in a loop. The pressing member is disposed in contact with an cuter circumferential surface of the fixing member. The contact member is provided inside the loop formed by the fixing member and is pressed against the pressing member via the fixing member to form a nip between the pressing member and the fixing member through which a recording medium bearing the toner image passes. The laminated heater facing an inner circumferential face of the fixing member heats the fixing member, connected to an external power source, and including a heat generation sheet. The heat generation sheet includes a heat-resistant resin in which conductive particles to receive electricity from the external power source and generate heat are unevenly dispersed throughout the heat-resistant resin to have a dispersal gradient of increasing particle dispersion density from an inner face toward an outer face of the heat generation sheet. The heater support supports the laminated heater along the inner circumferential face of the fixing member, and to which the contact member is fitted, the heater support sustaining the fixing member in its looped form.

Another embodiment of the present invention provides an image forming apparatus that includes a latent image carrier on which a latent image is formed, and the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
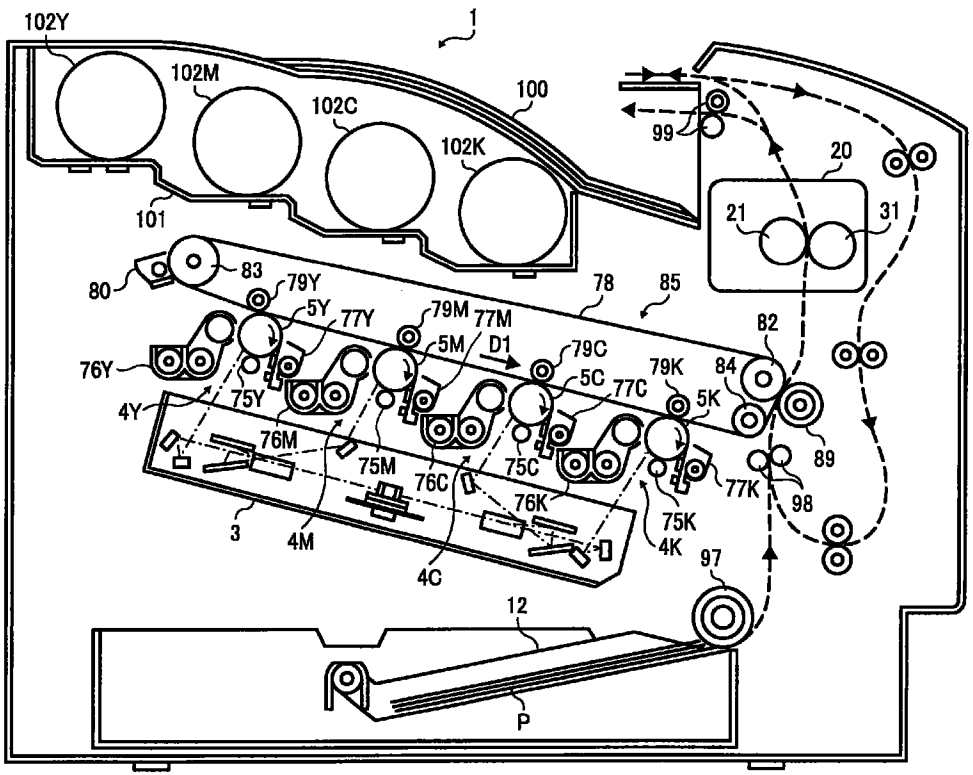
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic view of the image forming apparatus 1. As illustrated in FIG. 1, the image forming apparatus 1 may be a copier, a facsimile machine, a printer, a multifunction printer having at least one of copying, printing, scanning, plotter, and facsimile functions, or the like. According to this exemplary embodiment of the present invention, the image forming apparatus 1 is a tandem color printer for forming a color image on a recording medium.

As illustrated in FIG. 1, the image forming apparatus 1 includes an exposure device 3, image forming devices 4Y, 4M, 4C, and 4K, a paper tray 12, a fixing device 20, an intermediate transfer unit 85, a second transfer roller 89, a feed roller 97, a registration roller pair 98, an output roller pair 99, a stack portion 100, and a toner bottle holder 101.

The image forming devices 4Y, 4M, 4C, and 4K include photoconductive drums 5Y, 5M, 5C, and 5K, chargers 75Y, 75M, 75C, and 75K, development devices 76Y, 76M, 76C, and 76K, and cleaners 77Y, 77M, 77C, and 77K, respectively.

The fixing device 20 includes a fixing sleeve 21 and a pressing roller 31.

The intermediate transfer unit 85 includes an intermediate transfer belt 78, first transfer bias rollers 79Y, 79M, 79C, and 79K, an intermediate transfer cleaner 80, a second transfer backup roller 82, a cleaning backup roller 83, and a tension roller 84.

The toner bottle holder 101 includes toner bottles 102Y, 102M, 102C, and 102K.

The toner bottle holder 101 is provided in an upper portion of the image forming apparatus 1. The four toner bottles 102Y, 102M, 102C, and 102K contain yellow, magenta, cyan, and black toners, respectively, and are detachably attached to the toner bottle holder 101 so that the toner bottles 102Y, 102M, 102C, and 102K are replaced with new ones, respectively.

The intermediate transfer unit 85 is provided below the toner bottle holder 101. The image forming devices 4Y, 4M, 4C, and 4K are arranged opposite the intermediate transfer belt 78 of the intermediate transfer unit 85, and form yellow, magenta, cyan, and black toner images, respectively.

In the image forming devices 4Y, 4M, 4C, and 4K, the chargers 75Y, 75M, 75C, and 75K, the development devices 76Y, 76M, 76C, and 76K, the cleaners 77Y, 77M, 77C, and 77K, and dischargers surround the photoconductive drums 5Y, 5M, 5C, and 5K, respectively. Image forming processes including a charging process, an exposure process, a development process, a transfer process, and a cleaning process are performed on the photoconductive drums 5Y, 5M, 5C, and 5K to form yellow, magenta, cyan, and black toner images on the photoconductive drums 5Y, 5M, 5C, and 5K, respectively.

A driving motor drives and rotates the photoconductive drums 5Y, 5M, 5C, and 5K clockwise in FIG. 1. In the charging process, the chargers 75Y, 75M, 75C, and 75K uniformly charge surfaces of the photoconductive drums 5Y, 5M, 5C, and 5K at charging positions at which the chargers 75Y, 75M, 75C, and 75K are disposed opposite the photoconductive drums 5Y, SM, 5C, and 5K, respectively.

In the exposure process, the exposure device 3 emits laser beams L onto the charged surfaces of the photoconductive drums 5Y, 5M, 5C, and 5K, respectively. In other words, the exposure device 3 scans and exposes the charged surfaces of the photoconductive drums 5Y, 5M, 5C, and 5K at irradiation positions at which the exposure device 3 is disposed opposite the photoconductive drums 5Y, 5M, 5C, and 5K to irradiate the charged surfaces of the photoconductive drums 5Y, 5M, 5C, and 5K to form thereon electrostatic latent images corresponding to yellow, magenta, cyan, and black colors, respectively.

In the development process, the development devices 76Y, 76M, 76C, and 76K render the electrostatic latent images formed on the surfaces of the photoconductive drums 5Y, 5M, 5C, and 5K visible as yellow, magenta, cyan, and black toner images at development positions at which the development devices 76Y, 76M, 76C, and 76K are disposed opposite the photoconductive drums 5Y, 5M, 5C, and 5K, respectively.

In the transfer process, the first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78 at first transfer positions at which the first transfer bias rollers 79Y, 79M, 79C, and 79K are disposed opposite the photoconductive drums 5Y, 5M, 5C, and 5K via the intermediate transfer belt 78, respectively. Thus, a color toner image is formed on the intermediate transfer belt 78. After the transfer of the yellow, magenta, cyan, and black toner images, a slight amount of residual toner, which has not been transferred onto the intermediate transfer belt 78, remains on the photoconductive drums 5Y, 5M, 5C, and 5K.

In the cleaning process, cleaning blades included in the cleaners 77Y, 77M, 77C, and 77K mechanically collect the residual toner from the photoconductive drums 5Y, 5M, 5C, and 5K at cleaning positions at which the cleaners 77Y, 77M, 77C, and 77K are disposed opposite the photoconductive drums 5Y, 5M, 5C, and 5K, respectively.

Finally, dischargers remove residual potential on the photoconductive drums 5Y, 5M, 5C, and 5K at discharging positions at which the dischargers are disposed opposite the photoconductive drums 5Y, 5M, 5C, and 5K, respectively, thus completing a single sequence of image forming processes performed on the photoconductive drums 5Y, 5M, 5C, and 5K.

The intermediate transfer belt 78 is supported by and stretched over three rollers, which are the second transfer backup roller 82, the cleaning backup roller 83, and the tension roller 84. A single roller, that is, the second transfer backup roller 82, drives and endlessly moves (e.g., rotates) the intermediate transfer belt 78 in a direction indicated by a solid arrow D1 shown in FIG. 1.

The four first transfer bias rollers 79Y, 79M, 79C, and 79K and the photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite a polarity of toner forming the yellow, magenta, cyan, and black toner images on the photoconductive drums 5Y, 5M, 5C, and 5K, respectively. Accordingly, the yellow, magenta, cyan, and black toner images formed on the photoconductive drums 5Y, 5M, SC, and 5K, respectively, are transferred and superimposed onto the intermediate transfer belt 78 rotating in the direction D1 successively at the first transfer nips formed between the photoconductive drums 5Y, 5M, 5C, and 5K and the intermediate transfer belt 78 as the intermediate transfer belt 78 moves through the first transfer nips. Thus, a color toner image is formed on the intermediate transfer belt 78.

The paper tray 12 is provided in a lower portion of the image forming apparatus 1, and loads a plurality of recording media P (e.g., transfer sheets; recording medium). The feed roller 97 rotates counterclockwise in FIG. 1 to feed an uppermost recording medium P of the plurality of recording media P loaded on the paper tray 12 toward a roller nip formed between two rollers of the registration roller pair 98.

The registration roller pair 98, which stops rotating temporarily, stops the uppermost recording medium P fed by the feed roller 97 and reaching the registration roller pair 98. For example, the roller nips of the registration roller pair 98 contacts and stops a leading edge of the recording medium P. The registration roller pair 98 resumes rotating to feed the recording medium P to a second transfer nip, formed between the second transfer roller 89 and the intermediate transfer belt 78, as the color toner image formed on the intermediate transfer belt 78 reaches the second transfer nip.

At the second transfer nip, the second transfer roller 89 and the second transfer backup roller 82 sandwich the intermediate transfer belt 78. The second transfer roller 89 transfers the color toner image formed on the intermediate transfer belt 78 onto the recording medium P fed by the registration roller pair 98 at the second transfer nip formed between the second transfer roller 89 and the intermediate transfer belt 78. Thus, the desired color toner image is formed on the recording medium P. After the transfer of the color toner image, residual toner, which has not been transferred onto the recording medium P, remains on the intermediate transfer belt 78.

The intermediate transfer cleaner 80 collects the residual toner from the intermediate transfer belt 78 at a cleaning position at which the intermediate transfer cleaner 80 is disposed opposite the intermediate transfer belt 78, thus completing a single sequence of transfer processes performed on the intermediate transfer belt 78.

The recording medium P bearing the color toner image is sent to the fixing device 20. In the fixing device 20, the fixing sleeve 21 and the pressing roller 31 apply heat and pressure to the recording medium P to fix the color toner image on the recording medium P.

Thereafter, the fixing device 20 feeds the recording medium P bearing the fixed color toner image toward the output roller pair 99. The output roller pair 99 discharges the recording medium P to an outside of the image forming apparatus 1, that is, the stack portion 100. Thus, the recording media P discharged by the output roller pair 99 are stacked on the stack portion 100 successively to complete a single sequence of image forming processes performed by the image forming apparatus 1.

(First Embodiment)

Referring to FIGS. 2 to 5, the following describes the structure of the fixing device 20.

Figure 2:
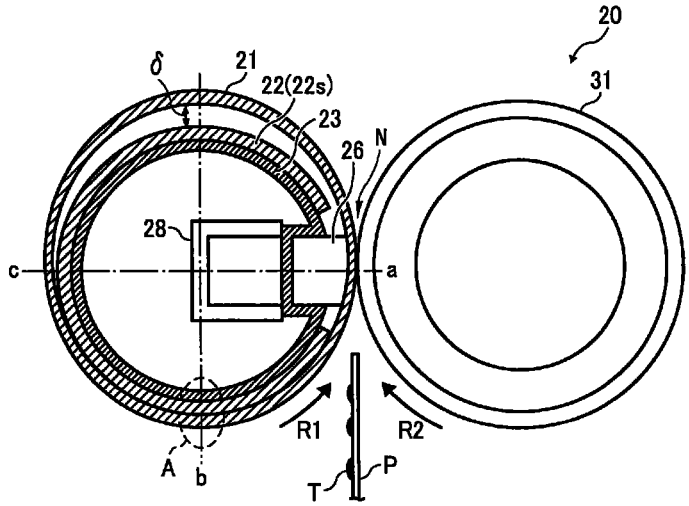
FIG. 2 is a sectional view of a fixing device included in the image forming apparatus shown in FIG. 1.

FIG. 2 is a vertical sectional view of the fixing device 20 according to a first embodiment. As illustrated in FIG. 2, the fixing device 20 further includes a laminated heater 22, a heater support 23, a contact member 26, and a core holder 28. As illustrated in FIG. 2, the fixing sleeve 21 is a rotatable endless belt serving as a fixing member or a rotary fixing member. The pressing roller 31 serves as a pressing member or a rotary pressing member that contacts an outer circumferential surface of the fixing sleeve 21. The contact member 26 is provided inside a loop formed by the fixing sleeve 21, and is pressed against the pressing roller 31 via the fixing sleeve 21 to form a nip N between the pressing roller 31 and the fixing sleeve 21 through which the recording medium P passes. The laminated heater 22 is provided inside the loop formed by the fixing sleeve 21, and contacts or is disposed close to an inner circumferential face of the fixing sleeve 21 to heat the fixing sleeve 21 directly or indirectly. The heater support 23 is provided inside the loop formed by the fixing sleeve 21 to support the laminated heater 22 at a predetermined position in such a manner that the heater support 23 and the fixing sleeve 21 sandwich the laminated heater 22. According to this exemplary embodiment, the laminated heater 22 contacts the inner circumferential face of the fixing sleeve 21 to heat the fixing sleeve 21 directly.

Figure 3A:
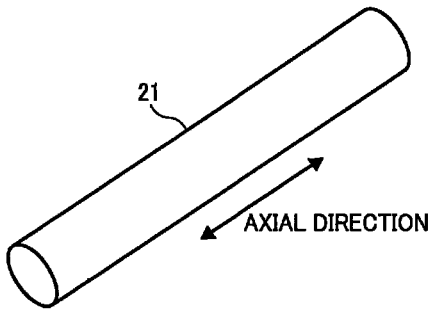
FIG. 3A is a perspective view of a fixing sleeve included in the fixing device shown in FIG. 2.
Figure 3B:
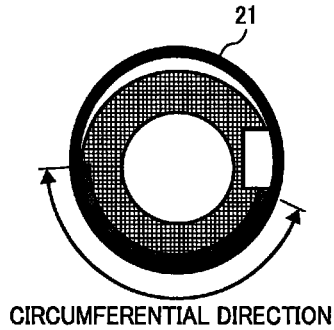
FIG. 3B is a sectional view of the fixing sleeve shown in FIG. 3A.

FIG. 3A is a perspective view of the fixing sleeve 21. FIG. 3B is a sectional view of the fixing sleeve 21. As illustrated in FIG. 3A, an axial direction of the fixing sleeve 21 corresponds to a long axis of the pipe-shaped fixing sleeve 21. As illustrated in FIG. 3B, a circumferential direction of the fixing sleeve 21 extends along a circumference of the pipe-shaped fixing sleeve 21. The fixing sleeve 21 is a flexible, pipe-shaped endless belt having a width in the axial direction of the fixing sleeve 21, which corresponds to a width of a recording medium P passing through the nip N between the fixing sleeve 21 and the pressing roller 31. For example, the fixing sleeve 21 is constructed of a base layer and at least a release layer provided on the base layer. The base layer is made of a metal material and has a thickness in a range of from about 30 μm to about 50 μm. The fixing sleeve 21 has an outer diameter of about 30 mm.

The base layer of the fixing sleeve 21 includes a conductive metal material such as iron, cobalt, nickel, or an alloy of those.

The release layer of the fixing sleeve 21 is a tube covering the base layer, and has a thickness of about 50 μm. The release layer includes a fluorine compound such as tetrafluoroethylene-perfluoroalkylvinylether copolymer (PFA). The release layer facilitates separation of toner of a toner image T on the recording medium P, which contacts the outer circumferential surface of the fixing sleeve 21 directly, from the fixing sleeve 21.

The pressing roller 31 depicted in FIG. 2 is constructed of a metal core including a metal material such as aluminum or copper; a heat-resistant elastic layer provided on the metal core and including silicon rubber (e.g., solid rubber); and a release layer provided on the elastic layer. The pressing roller 31 has an outer diameter of about 30 mm. The elastic layer has a thickness of about 2 mm. The release layer is a PFA tube covering the elastic layer and has a thickness of about 50 μm. A heat generator, such as a halogen heater, may be provided inside the metal core as needed. A pressing mechanism presses the pressing roller 31 against the contact member 26 via the fixing sleeve 21 to form the nip N between the pressing roller 31 and the fixing sleeve 21. For example, a portion of the pressing roller 31 contacting the fixing sleeve 21 causes a concave portion of the fixing sleeve 21 at the nip N. Thus, the recording medium P carrying the toner image T passing through the nip N moves along the concave portion of the fixing sleeve 21.

A driving mechanism drives and rotates the pressing roller 31, which presses the fixing sleeve 21 against the contact member 26, clockwise in FIG. 2 in a rotation direction R2. Accordingly, the fixing sleeve 21 rotates in accordance with rotation of the pressing roller 31 counterclockwise in FIG. 2, in a rotation direction R1.

A long axis of the contact member 26 corresponds to the axial direction of the fixing sleeve 21. At least a portion of the contact member 26 that is pressed against the pressing roller 31 via the fixing sleeve 21 includes a heat-resistant elastic material such as fluorocarbon rubber. The core holder 28 holds and fixes the contact member 26 at a predetermined position inside the loop formed by the fixing sleeve 21. As illustrated in FIG. 2, the core holder 28 holds the contact member 26 via the heater support 23 such that the contact member 26 is fitted in a recessed groove formed in an outer circumferential face of the heater support 23 extending in an axial direction of the heater support 23. A portion of the contact member 26 that contacts the inner circumferential face of the fixing sleeve 21 may include a slidable and durable material such as Teflon® sheet.

The core holder 28 is made of sheet metal, and has a width in a long axis thereof corresponding to the width of the fixing sleeve 21 in the axial direction of the fixing sleeve 21. The core holder 28 is a rigid member having a square U-like in cross-section shape (that is, a rectangular shape with one open side), and is provided at substantially a center position inside the loop formed by the fixing sleeve 21.

The core holder 28 supports the contact member 26 on the opposite side (back face) of the nip N, and prevents substantial deformation of the contact member 26 when the pressing roller 31 presses the fixing sleeve 21 against the contact member 26.

A heat insulator may be provided between the contact member 26 and the core holder 28 so as to prevent the heat from leaking from the contact member 26 through the core holder 28, thereby preventing or reducing a decrease in temperature in the nip N. In addition, the core holder 28 further holds the heater support 23.

The heater support 23 supports the laminated heater 22 in such a manner that the laminated heater 22 either contacts the inner circumferential face of the fixing sleeve 21 or the laminated heater 22 is disposed close to the inner circumferential face of the fixing sleeve 21 across a predetermined gap. In addition, the heater support 23 maintains stable rotation of the fixing sleeve 21 while keeping the fixing sleeve 21 in the proper, substantially looped shape. Accordingly, the heater support 23 includes an arc-shaped outer circumferential face having a predetermined circumferential length and disposed along the inner circumferential face of the circular fixing sleeve 21 in cross-section.

The heater support 23 has a heat resistance that resists heat generated by the laminated heater 22 and a strength sufficient to support the laminated heater 22 without being deformed by the fixing sleeve 21 when the rotating fixing sleeve 21 contacts the laminated heater 22. For example, the heater support 23 is a pipe-shaped hollow cylinder, and is fixed in position on the inner circumferential side of the fixing sleeve 21. The heater support 23 is formed of a rigid metal material such as aluminum, copper, or iron.

In addition, it is preferable that the heater support 23 have sufficient heat insulation such that it does not transmit the heat generated in the laminated heater 22 to the core holder 28 side but instead transmits the heat to the fixing sleeve 21 side. For example, a second heat insulator may be provided between the heater support 23 and the core holder 28.

The heater support 23 may be supported by the core holder 28. Alternatively, both ends of the heater support 23 may be immovably mounted on a frame of the fixing device 20.

The laminated heater 22 includes a heat generation sheet 22*s* formed of a heat-resistant resin 22*b* (shown in FIG. 4) having heat-resistant and electrically insulative properties as a base material and electrically conductive particles 22*a* (shown in FIG. 4) dispersed in the base material.

Figure 4:
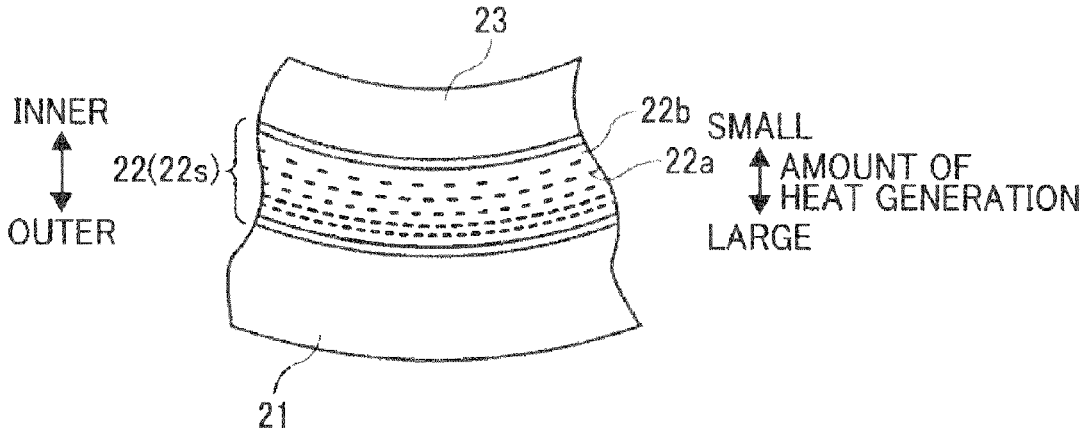
FIG. 4 is a partial sectional view of a laminated heater included in the fixing device shown in FIG. 2.

FIG. 4 is a partial cross-sectional view of the laminated heater 22 in the fixing device 20. More specifically, FIG. 4 is an expanded view illustrating a portion of the fixing device 20 shown in FIG. 2. As illustrated in FIG. 4, the heat generation sheet 22*s*, functioning as the laminated heater 22, is located between the fixing sleeve 21 and the heater support 23.

The heat generation sheet 22*s* is a flexible sheet. In the heat generation sheet 22*s*, the conductive particles 22*a* are unevenly dispersed in the heat-resistant resin 22*b* to have a dispersal gradient of increasing particle dispersion density from an inner face facing the heater support 23 toward an outer face of the heat generation sheet 22*s* facing the fixing sleeve 21.

In addition, the laminated heater 22 includes electrode terminals, not shown, to supply electrical power from a power source, not shown, to the heat generation sheet 22*s*, connected to both ends of the heat generation sheet 22*s*.

The heat generation sheet 22*s* has a thickness in a range of from about 0.1 mm to about 1.0 mm, and has a flexibility sufficient to wrap around the heater support 23 depicted in FIG. 2 at least along an outer circumferential face of the heater support 23.

The base material is a thin, elastic film including the heat-resistant resin, such as polyethylene terephthalate (PET) or polyimide resin 22*b*. For example, the base layer 22*b* may be a film including polyimide resin to provide heat resistance, insulation, and a certain level of flexibility.

The conductive particles 22*a* are carbon particles or metal particles.

The carbon particles used as the conductive particles 22*a* may be known carbon black powder or carbon nanoparticles formed of at least one of carbon nanofiber, carbon nanotube, and carbon microcoil. The metal particles used as the conductive particles 22*a* may be silver, aluminum, or nickel particles, and may be granular or filament-shaped.

The above-configured heat generation sheet 22*s* is supplied with electrical power from the power source (external power or capacitor) and generates Joule heat due to internal resistance in the heat generation sheet 22*s*. Because the distribution, that is, the dispersion density, of the conductive particles 22*a* has a gradient in the thickness direction (radial direction) of the heat generation sheet 22*s*, a heat gradient (gradient of heat distribution) is created in the heat generation sheet 22*s*. More specifically, in the thickness direction of the heat generation sheet 22*s*, the amount of heat generation increases toward the outer face facing the fixing sleeve 21 (top face side), and conversely, the amount of heat generation decreases toward an inner face facing the heater support 23 (back face side).

With this configuration, a substantial amount of the heat generated in the heat generation sheet 22*s* can be transmitted to the fixing sleeve 21 while the heat is prevented from flowing to the back face side (the heater support 23 side), therefore enabling the fixing sleeve 21 to be effectively heated. In addition, the heat generation sheet 22*s* has the heat gradient, such that the amount of heat generated is gradually changed in the thickness direction of the heat generation sheet 22*s*, which prevents formation of an area having a large temperature difference in the thickness direction in the heat generation sheet 22*s*. Thus, layer separation in the heat generation sheet 22*s* can be prevented.

In manufacturing the heat generation sheet 22*s*, a thin layer is formed with a coating material in which the conductive materials 22*a*, such as carbon particles or metal particles, are dispersed in a precursor of the heat-resistant resin 22*b*, such as a polyimide. Then, repeating the forming layer processes and the layer thus formed are laminated, the heat generation sheet 22*s* reaches a target thickness. In this manufacturing process, the amount of the conductive particles 22*a* added to the coating material is gradually increased from an inner thin layer to an outer thin layer in the thickness direction. For example, the coating material for the lowermost thin layer does not contain the conductive particles 22*a*, and the second lowest thin layer includes a predetermined amount of the conductive particles 22*a*. Similarly, as the position of the thin layer goes up, the amount of the conductive particles 22*a* contained in the thin layer is increased at a predetermined constant rate within a range from about 2.0% to 20% as appropriate.

In addition, it is preferable that an electrically insulating layer formed of a heat-resistant resin such as polyimide be laminated on the highest layer. Furthermore, in order to improve the durability of heat generation sheet 22*s* to contact against the inner circumferential face of the fixing sleeve 21, a fluoro-resin covers the outer face (top face) of the heat generation sheet 22*s*.

The area over which the heat generation sheet 22*s* extends relative to the inner circumferential face of the fixing sleeve 21 is determined in view of the amount of heat generated in the heat generation sheet 22*s* and heating efficiency in the fixing sleeve 21. For example, as illustrated in FIG. 2, the heat generation sheet 22*s* is extended from a nip exit to a nip entrance in a circumferential direction along the inner circumferential face of the fixing sleeve 21. With this position, because the heat generation sheet 22*s* is mounted on the fixing sleeve 21 so that a small gap δ (0 mm<δ≤1 mm) is formed between the heat generation sheet 22*s* and the fixing sleeve 21 in the area except the nip N, the heat from the heat generation sheet 22*s* can be effectively transmitted to the fixing sleeve 21.

Herein, when the fixing sleeve 21 is rotated with rotation of the pressing roller 31, the fixing sleeve 21 is pulled (stretched taut) by the pressing roller 31 at the nip N. Thus, the upstream portion from the nip N (lower circle A shown in FIG. 2) is a pulling portion to which the pulling force is applied, and the inner circumferential face of the fixing sleeve 21 is positioned closer to the heat generation sheet 22*s* provided on the heater support 23 (see FIG. 4). Alternatively, in the upstream portion from the nip N, the inner circumferential face of the fixing sleeve 21 slides on the laminated heater 22 while the inner circumferential face of the fixing sleeve 21 presses against the heater support 23 via the heat generation sheet 22*s*.

By contrast, the downstream portion from the nip N of the fixing sleeve 21 is slackened without the pulling force of the fixing sleeve 21, and therefore, the gap δ between the fixing sleeve 21 and the heat generation sheet 22*s* widens.

Accordingly, as illustrated in FIG. 2, the heat generated in the heat generation sheet 22*s* is effectively transmitted to the upstream area from the nip N in the circumferential direction (lower circle A shown in FIG. 2) of the fixing sleeve 21, and the heat generated in the heat generation sheet 22*s* is less likely to be transmitted to the downstream area in the nip N in the circumferential direction in the fixing sleeve 21.

Therefore, the heat generation sheet 22*s* having a greater gradient in the distribution of the conductive particles 22*a* (dispersal density), in which the amount of heat generation is increased in the outer face (top layer) facing the fixing sleeve 21 (top face side), may be provided in the upstream area from the nip N in the circumferential direction (lower circle A shown in FIG. 2), for example, within an angle ranging from the nip N (angle of rotation is 0) to a position 180 degree from the nip N toward the upstream portion (range indicated by quadrants a-b-c).

Herein, in the configuration shown in FIG. 4, although the heat generation sheet 22*s* has good heat efficiency because the heat generation sheet 22*s* can directly heat the corresponding inner circumferential face of the fixing sleeve 21, the heat generation sheet 22*s* may be damaged by attrition, in that the heat generation sheet 22*s* slides over the fixing sleeve 21. In addition, when the fixing sleeve 21 is formed of a metal material, the outer face (top face) of the heat generation sheet 22*s* coated with the thin electrical insulation film is lost by sliding therebetween, which may degrade the electrical insulation performance between the heat generation sheet 22*s* and the fixing sleeve 21.

Figure 5:
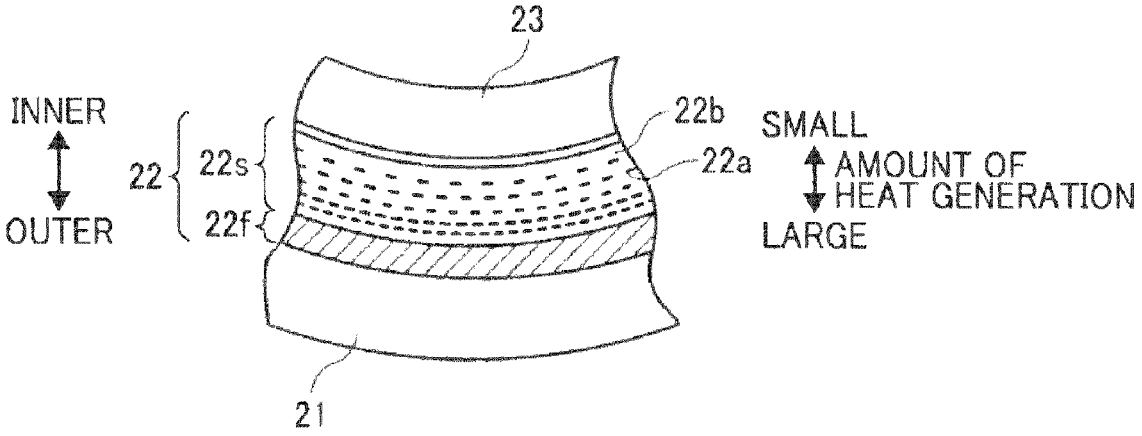
FIG. 5 is a partial sectional view of a variation of a laminated heater included in the fixing device shown in FIG. 2.

In order to solve this problem, as illustrated in FIG. 5, the laminated heater 22 may further include a thermal conduction film 22*f* disposed on the outer face of the heat generation sheet 22*s* on the fixing sleeve 21 side in addition to the heat generation sheet 22*s* that is fixed on the heater support 23. FIG. 5 is a partial sectional view of another configuration of the laminated heater 22 in the fixing device 20.

Herein, the thermal conduction film 22*f* is constructed of a heat-resistant resin film in which metal filler is dispersed and is electrically insulative (have electrical insulation performance between a top face and a back face thereof). More specifically, in the thermal conduction film 22*f*, the metal filler maintains good thermal conductivity in the thickness direction thereof, and at the same time the electrical insulation performance can be ensured by sparsely dispersing the metal fillers in the heat-resistant resin film.

As described above, by providing the thermal conduction film 22*f* between the heat generation sheet 22*s* and the fixing sleeve 21, the electrical insulation performance between the heat generation sheet 22*s* and the fixing sleeve 21 can be maintained, and the heat in the heat generation sheet 22*s* can be effectively transmitted to the fixing sleeve 21.

Herein, the following describes assembly processes for assembling the fixing device 20, that is, steps for putting together the components provided inside the loop formed by the fixing sleeve 21.

Initially, the heat generation sheet 22*s* of the laminated heater 22 is adhered to the heater support 23 with an adhesive along the outer circumferential face of the heater support 23. The adhesive may have a small heat conductivity to prevent heat transmission from the heat generation sheet 22*s* to the heater support 23. At this time, the electrode terminal connected to the heat generation sheet 22*s* is pulled out from the end portions of the heat generation sheet 22*s* in the axial direction of the fixing sleeve 21. Subsequently, the contact member 26 is attached to the recessed groove in the heater support 23.

Then, the core holder 28 is inserted into the interior of the heater support 23, and the core holder 28 is fixed in place so as to hold the contact member 26. Thus, an internal mechanism is completely assembled.

Finally, the internal mechanism is inserted into the interior of the loop-shaped fixing sleeve 21 and set as shown in FIG. 2, and the electrode terminal connected to the heat generation sheet 22*s* is connected to electrical power supply wiring to complete the assembly process.

When the entire inner face of the heat generation sheet 22*s* facing the heater support 23 is adhered to the heater support 23, heat generated by the heat generation sheet 22*s* moves from the entire inner face of the heat generation sheet 22*s* to the heater support 23 easily.

To address this problem, lateral end portions of the heat generation sheet 22*s* in the axial direction of the fixing sleeve 21, which correspond to a non-conveyance region on the fixing sleeve 21 through which the recording medium P is not conveyed, are adhered to the heater support 23 to prevent the heat generation sheet 22*s* from shifting from the proper position. Further, a center portion of the heat generation sheet 22*s* in the axial direction of the fixing sleeve 21, which corresponds to a conveyance region on the fixing sleeve 21 through which the recording medium P is conveyed, that is, a maximum conveyance region corresponding to a width of the maximum recording medium P, is not adhered to the heater support 23 and therefore is isolated from the heater support 23. Accordingly, heat is not transmitted from the center portion of the heat generation sheet 22*s* in the axial direction of the fixing sleeve 21 to the heater support 23. As a result, heat generated at the center portion of the heat generation sheet 22*s* is used effectively to heat the fixing sleeve 21.

The heat generation sheet 22*s* may be adhered to the heater support 23 with a liquid adhesive for coating. Alternatively, a tape adhesive (e.g., a double-faced adhesive tape), which provides adhesion on both sides thereof and includes a heat-resistant acryl or silicon material, may be used. Accordingly, the laminated heater 22 (e.g., the heat generation sheet 22*s*) is adhered to the heater support 23 easily. Further, if the laminated heater 22 malfunctions, the laminated heater 22 can be replaced easily by peeling off the double-faced adhesive tape, facilitating maintenance.

It is to be noted that, if the heat generation sheet 22*s* and the heater support 23 merely sandwich the double-faced adhesive tape, the lateral end portions of the heat generation sheet 22*s* in the axial direction of the fixing sleeve 21, which are adhered to the heater support 23, are lifted by a thickness of the double-faced adhesive tape. Accordingly, the center portion of the heat generation sheet 22*s* in the axial direction of the fixing sleeve 21, which is not adhered to the heater support 23, does not contact the fixing sleeve 21 uniformly, decreasing heating efficiency for heating the fixing sleeve 21 and varying temperature distribution of the fixing sleeve 21 in the axial direction of the fixing sleeve 21.

To address this problem, the lateral end portions of the heat generation sheet 22*s* in the axial direction of the fixing sleeve 21, which are adhered to the heater support 23 with the double-faced adhesive tape, have a thickness decreased by the thickness of the double-faced adhesive tape.

The laminated heater 22 further includes edge grooves and double-faced adhesive tapes. The edge grooves are provided at lateral edges, which correspond to the non-conveyance region on the fixing sleeve 21 through which the recording medium P is not conveyed, of the heat generation sheet 22*s* in the axial direction of the fixing sleeve 21, respectively, on the inner face (back face) of the heat generation sheet 22*s* that faces the heater support 23, and extend in the circumferential direction of the fixing sleeve 21. Each of the edge grooves has a depth equivalent to the thickness (e.g., about 0.1 mm) of the double-faced adhesive tape.

The double-faced adhesive tapes are adhered to the edge grooves of the heat generation sheet 22*s*, respectively, and then adhered to the heater support 23. In other words, the heat generation sheet 22*s* is adhered to the heater support 23 at predetermined positions on the heater support 23 via the double-faced adhesive. Accordingly, when the heat generation sheet 22*s* is adhered to the heater support 23, the outer face (top face) of the heat generation sheet 22*s* that faces the fixing sleeve 21 is planar in the axial direction of the fixing sleeve 21. Consequently, the heat generation sheet 22*s* uniformly contacts the fixing sleeve 21 at the center portion of the heat generation sheet 22*s* corresponding to the conveyance region on the fixing sleeve 21 over which the recording medium P is conveyed, providing improved heating efficiency for heating the fixing sleeve 21 and uniform temperature distribution of the fixing sleeve 21 in the axial direction of the fixing sleeve 21.

Alternatively, edge grooves may be provided in the heater support 23 instead of in the heat generation sheet 22*s*. The edge grooves are provided at lateral edges of the heater support 23 in the axial direction of the fixing sleeve 21, which correspond to the non-conveyance region on the fixing sleeve 21 through which the recording medium P is not conveyed. A face of the heater support 23 faces the heat generation sheet 22*s*, and extends in the circumferential direction of the fixing sleeve 21. Each of the edge grooves has a depth equivalent to the thickness of the double-faced adhesive tape. The double-faced adhesive tapes are adhered to the edge grooves of the heater support 23, respectively, and then the heat generation sheet 22*s* is adhered to the heater support 23 via the double-faced adhesive tapes. Accordingly, when the heat generation sheet 22*s* is adhered to the heater support 23, the outer face of the heat generation sheet 22*s* that faces the fixing sleeve 21 is planar in the axial direction of the fixing sleeve 21. Consequently, the heat generation sheet 22*s* uniformly contacts the fixing sleeve 21 at the center portion of the heat generation sheet 22*s* corresponding to the conveyance region on the fixing sleeve 21 over which the recording medium P is conveyed, providing improved heating efficiency for heating the fixing sleeve 21 and uniform temperature distribution of the fixing sleeve 21 in the axial direction of the fixing sleeve 21.

Figure 6:
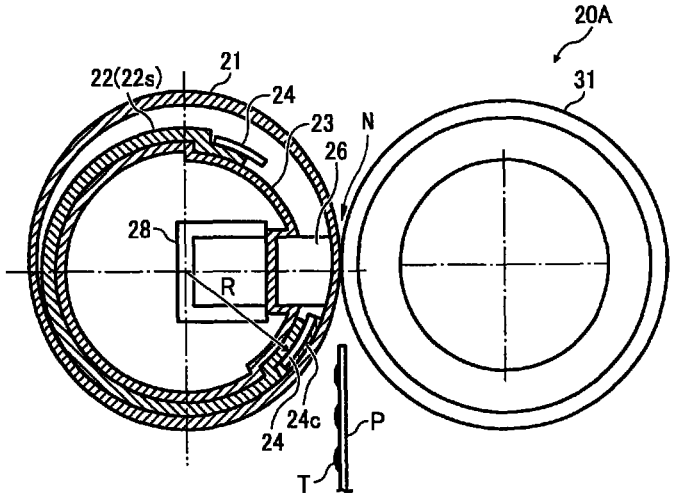
FIG. 6 a sectional view of a variation of the fixing device shown in FIG. 2.

FIG. 6 is a cross-sectional view illustrating a fixing device 20A according to a variation of the first embodiment. More specifically, FIG. 6 illustrates a cross-sectional view in a center portion of the fixing sleeve 21 in the axial direction.

In FIG. 6, the fixing device 20A further includes a retainer 24 that fixes the laminated heater 22 (heat generation sheet 22*s*) on the outer circumferential face of the heater support 23 in such a manner that the retainer 24 and the outer circumferential face of the heater support 23 sandwich the heat generation sheet 22*s* of the laminated heater 22.

It is to be noted that, for ease of explanation and illustration, because other than the difference described above the fixing device 20A has a configuration similar to the configuration of the fixing device 20 in the first embodiment, other components of the fixing device 20A represented by identical numerals and the description thereof is omitted below.

Figure 7:
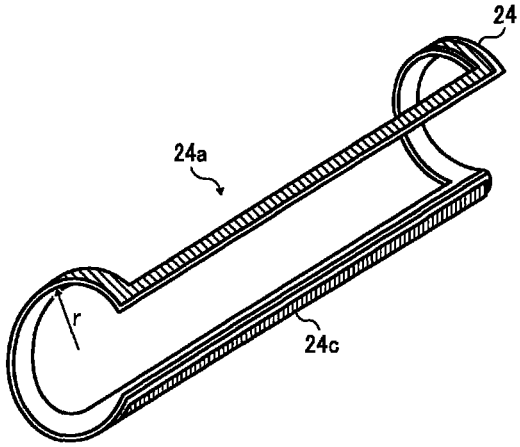
FIG. 7 is a perspective view illustrating a retainer included in the fixing device shown in FIG. 6.

Herein, the retainer 24 is a pipe-shaped cylindrical hollow formed of thin metal such as iron or stainless steel, and has a thickness in a range of from 0.1 mm to 1.0 mm, and an outer circumferential face of the retainer 24 is cut and opened as an opening 24*a* in a longitudinal direction on the nip N side (see FIG. 7).

The retainer 24 has a certain elasticity (spring characteristics), such that, when attached to the heater support 23 so that the heater support 23 is contained in an inner circumferential portion of the retainer 24 through the opening 24*a* of the retainer 24, the retainer 24 is fitted around the heater support 23 so as to tightly wrap around the outer circumferential face of the heater support 23. An inner circumferential face of the cylindrical pipe of the retainer 24 closely contacts the heater support 23 along the outer circumferential face of the heater support 23.

Therefore, in the fixing device 20A shown in FIG. 6, in a state in which the laminated heater 22 (the heat generation sheet 22*s*) is located at a predetermined position on the outer circumferential face of the heater support 23 and the retainer 24 is engaged with the outer circumferential portion of the heater support 23 through the opening 24*a* of the retainer 24, the retainer 24 fixes the heat generation sheet 22*s* of the laminated heater 22 on the outer circumferential face of the heater support 23 in such a manner that the retainer 24 and the outer circumferential face of the heater support 23 sandwich the laminated heater 22.

In addition, the retainer 24 is removably attached to the heater support 23, which can facilitate replacement of the heat generation sheet 22*s* for maintenance, and the like.

In FIGS. 6 and 7, reference character "R" represents an external radius of the heater support 23 in the portion holding the laminated heater 22, that is, a distance between its axial center and the outer circumferential face, and reference character "r" represents an internal radius of the cylindrical pipe of the retainer 24. When the radius "r" is smaller than the radius "R" (R>r), in installation of the retainer 24 in the heater support 23, the retainer 24 can be engaged with the heater support 23 while wrapping around the heater support 23, thus tightly holding the heat generation sheet 22*s* of the laminated heater 22.

Further, it is preferable that steps (recessed portions) descending inwardly be provided on the outer circumferential face of the heater support 23, positioned close to the entrance and exit of the nip N because the ends of the opening 24*a* of the retainer 24 can engage the steps, thus facilitating attachment of the retainer 24.

In addition, the retainer 24 may have the opening 24*a* to expose the heat generation sheet 22*s* of the laminated heater 22 to the inner circumferential face of the fixing sleeve 21. With this configuration, the retainer 24 can fix the heat generation sheet 22*s* of the laminated heater 22, and the heat generation sheet 22*s* of the laminated heater 22 can directly face and heat the inner circumferential face of the fixing sleeve 21.

Further, a heat insulator 24*c* may be provided on the outer circumferential face of the retainer 24 on the fixing sleeve 21 side to prevent endothermic reaction of the retainer 24 from the fixing sleeve 21. Accordingly, localized fluctuations in the temperature in the fixing sleeve 21 can be prevented.

Next, referring back to FIG. 2, the following describes operation of the fixing device 20(20A) having the above-described structure.

When the image forming apparatus 1 receives an output signal, for example, when the image forming apparatus 1 receives a print request specified by a user by using a control panel or a print request sent from an external device, such as a personal computer, the pressing roller 31 is pressed against the contact member 26 via the fixing sleeve 21 to form the nip N between the pressing roller 31 and the fixing sleeve 21.

Thereafter, a driver drives and rotates the pressing roller 31 clockwise in FIG. 2 in the rotation direction R2. Accordingly, the fixing sleeve 21 rotates counterclockwise in FIG. 2 in the rotation direction R1 in accordance with rotation of the pressing roller 31. In a state in which the laminated heater 22 supported by the heater support 23, the laminated heater 22 is disposed close to the inner circumferential face of the fixing sleeve 21 across a predetermined narrow gap, or the laminated heater 22 contacts the inner circumferential face of the fixing sleeve 21, and the fixing sleeve 21 slides over the laminated heater 22.

Simultaneously, an external power source or an internal capacitor supplies power to the laminated heater 22 via the power supply wire to cause the heat generation sheet 22*s* to generate heat. The heat generated by the heat generation sheet 22*s* is transmitted effectively to the fixing sleeve 21 contacting the heat generation sheet 22*s*, so that the fixing sleeve 21 is heated quickly.

Alternatively, heating of the fixing sleeve 21 by the laminated heater 22 may not start simultaneously with driving of the pressing roller 31 by the driver. In other words, the laminated heater 22 may start heating the fixing sleeve 21 at a time different from a time at which the driver starts driving the pressing roller 31.

A temperature detector is provided at a position upstream from the nip N in the rotation direction R1 of the fixing sleeve 21. For example, the temperature detector may be provided outside the loop formed by the fixing sleeve 21 to face the outer circumferential surface of the fixing sleeve 21 with or without contacting the fixing sleeve 21. Alternatively, the temperature detector may be provided inside the loop formed by the fixing sleeve 21 to face the heater support 23 with or without contacting the heater support 23. The temperature detector detects a temperature of the fixing sleeve 21 or the heater support 23 to control heat generation of the laminated heater 22 based on a detection result provided by the temperature detector so as to heat the nip N up to a predetermined fixing temperature. When the nip N is heated to the predetermined fixing temperature, the fixing temperature is maintained, and the recording medium P is conveyed to the nip N.

When the image forming apparatus 1 does not receive an output signal, the pressing roller 31 and the fixing sleeve 21 do not rotate and power is not supplied to the laminated heater 22, to reduce power consumption. However, in order to restart the fixing device 20 immediately after the image forming apparatus 1 receives an output signal, power can be supplied to the laminated heater 22 while the pressing roller 31 and the fixing sleeve 21 do not rotate. For example, power in an amount sufficient to keep the entire fixing sleeve 21 warm is supplied to the laminated heater 22.

As described above, in the fixing device 20 according to the present embodiment, the fixing sleeve 21 and the laminated heater 22 have a small heat capacity, shortening a warm-up time and a first print time of the fixing device 20 while saving energy. Further, the heat generation sheet 22*s* is a resin sheet. Accordingly, even when rotation and vibration of the pressing roller 31 applies stress to the heat generation sheet 22*s* repeatedly, and bends the heat generation sheet 22*s* repeatedly, the heat generation sheet 22*s* is not broken due to wear, and the fixing device 20 operates for a longer time.

In addition, because the heat generation sheet 22*s* that directly contacts the inner circumferential face of the fixing sleeve 21 has a predetermined heat gradient (gradient of heating distribution) so that the amount of heat generation increases toward the outer face facing the fixing sleeve 21, a substantial amount of the heat generated in the heat generation sheet 22*s* can be transmitted to the fixing sleeve 21 while the heat is prevented from flowing to the inner face side (the heater support 23 side), and therefore, the fixing sleeve 21 can be effectively heated.

(Second Embodiment)

Figure 8:
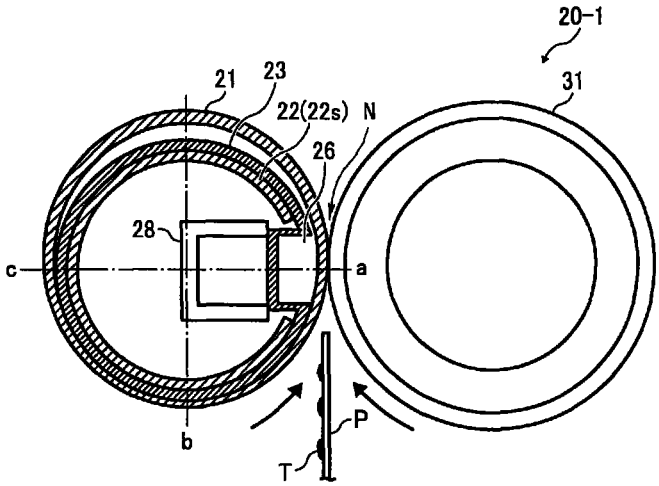
FIG. 8 is a sectional view of a fixing device included in the image forming apparatus shown in FIG. 1 according to another exemplary embodiment.

Next, a fixing device 20-1 according to a second embodiment is described below with reference to FIG. 8. FIG. 8 is a cross-sectional diagram illustrating the fixing device 20-1.

As illustrated in FIG. 8, the heat generation sheet 22*s* of the laminated heater 22 is provided on the inner circumferential face of the heater support 23, while other components as well as the operation and control of the fixing device 20-1 are similar to the fixing device 20 according to the first embodiment shown in FIG. 2.

(Variation of the Second Embodiment)

Figure 9:
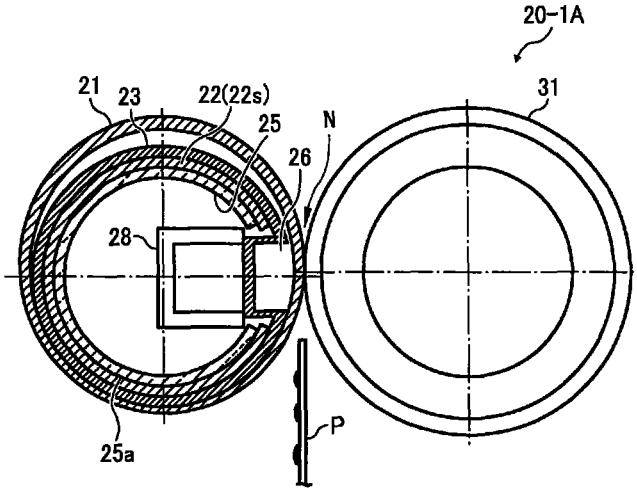
FIG. 9 is a sectional view of a variation of the fixing device shown in FIG. 8.

As a variation of the above-described embodiment, as illustrated in FIG. 9, the laminated heater 22 (the heat generation sheet 22*s*) may be fixed by a retainer 25 on the inner circumferential face of the heater support 23.

FIG. 9 is a cross-sectional diagram illustrating a fixing device 20-1A according to the variation of the second embodiment In FIG. 9, the fixing device 20-1A includes the retainer 25 that fixes the heat generation sheet 22*s* of the laminated heater 22 on the inner circumferential face of the heater support 23 in such a manner that the retainer 25 and the inner circumferential face of the heater support 23 sandwiches the laminated heater 22, while the other components in the fixing device 20-1A are similar to the fixing device 20-1 according to the second embodiment shown in FIG. 8.

Herein, the retainer 25 is a pipe-shaped cylindrical hollow formed of thin metal such as iron or stainless steel, and has a thickness in a range of from 0.1 mm to 1.0 mm, and an outer circumferential surface of the retainer 25 is cut and opened in a longitudinal direction on the nip N side.

When the retainer 25 is attached to the heat generation sheet 22*s* of the laminated heater 22 so that the heater support 23 is contained in the inner circumferential portion of the heat generation sheet 22*s* of the heater support 23, the retainer 25 is closely contacted so as to be positioned along the inner circumferential face of the heater support 23 via the heat generation sheet 22*s* and expands it by spring characteristics of the retainer 25. The outer circumferential face of the cylindrical pipe of the retainer 25 closely contacts the heater support 23 via the laminated heater 22 along the inner circumferential face of the laminated heater 22.

Therefore, in the fixing device 20-1A shown in FIG. 9, when the laminated heater 22 of the heat generation sheet 22*s* is disposed at a predetermined position on the inner circumferential face of the heater support 23 in such a manner that the retainer 25 is fitted into the inner circumferential portion of the heater support 23, the retainer 25 can fix the heat generation sheet 22*s* of the laminated heater 22 on the inner circumferential face of the heater support 23 in a such a manner that the retainer 25 and the inner circumferential face of the heater support 23 sandwich the laminated heater 22.

In addition, the retainer 25 is a removable member that can be removably attached to the heater support 23, which can facilitate maintenance and replacement of the heat generation sheet 22*s*.

Herein, "R'" represents an internal radius of the heat generation sheet 22*s* of the laminated heater 22, and "r'" represents an external radius of the hollow cylindrical of the retainer 25. In this state, in a condition that the radius R' is smaller than the radius r', when the retainer 25 is attached to the heater support 23, the retainer 25 can be fitted inside the heater support 23 so that the retainer 25 exposes the inner circumference of the heater support 23. Thus, the retainer 25 tightly holds the heat generation sheet 22*s* of the laminated heater 22.

In addition, by providing a heat insulator 25*a* on the outer circumferential face of the retainer 25 on the laminated heater 22 side, the retainer 25 may be prevented from absorbing heat from the laminated heater 22. Therefore, decrease in the heat efficiency of the fixing sleeve 21 heated by of the laminated heater 22 can be prevented.

As described above, in the fixing device 20-1(20-1A) according to the second embodiment, the fixing sleeve 21 and the laminated heater 22 have a small heat capacity, shortening a warm-up time and a first print time of the fixing device 20-1(20-1A) while saving energy. Further, the heat generation sheet 22*s* is a resin sheet. Accordingly, even when rotation and vibration of the pressing roller 31 applies stress to the heat generation sheet 22*s* repeatedly, and bends the heat generation sheet 22*s* repeatedly, the heat generation sheet 22*s* is not broken due to wear, and the fixing device 20-1 operates for a longer time.

In addition, because the heat generation sheet 22*s* that directly contacts the inner circumferential face of the fixing sleeve 21 has a predetermined heat gradient (gradient of heating distribution) so that the amount of heat generation increases toward the outer face facing the fixing sleeve 21, a substantial amount of the heat generated in the heat generation sheet 22*s* can be transmitted to the fixing sleeve 21 while the heat is prevented from flowing to the inner face side (the heater support 23 side), and therefore, the fixing sleeve 21 can be effectively heated.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device for fixing a toner image on a recording medium, comprising:

an endless belt-shaped fixing member to rotate in a predetermined direction, formed in a loop;

a pressing member disposed in contact with an outer circumferential surface of the fixing member;

a contact member provided inside the loop formed by the fixing member and pressed against the pressing member via the fixing member to form a nip between the pressing member and the fixing member through which the recording medium bearing the toner image passes;

a laminated heater facing an inner circumferential face of the fixing member to heat the fixing member, connected to an external power source, and comprising a heat generation sheet comprising a heat-resistant resin in which conductive particles to receive electricity from the external power source and generate heat are unevenly dispersed throughout the heat-resistant resin to have a dispersal gradient of increasing particle dispersion density from an inner face toward an outer face of the heat generation sheet; and a generally cylindrical heater support to support the laminated heater along the inner circumferential face of the fixing member, and to which the contact member is fitted, the heater support sustaining the fixing member in its looped form.

2. The fixing device according to claim 1, wherein the laminated heater further comprises an electrically insulative thermal conduction film comprising a heat-resistant film in which metal filler is dispersed, disposed on the outer face of the heat generation sheet.

3. The fixing device according to claim 1, wherein the laminated heater is attached to an outer circumferential face of the heater support.

4. The fixing device according to claim 3, further comprising:

a retainer to support the laminated heater between the outer circumferential face of the heater support and the retainer and fix the laminated heater on the outer circumferential face of the heater support.

5. The fixing device according to claim 4, wherein the retainer is shaped generally as a cylinder.

6. The fixing device according to claim 5, wherein the retainer has an opening therein to expose the heat generation sheet of the laminated heater to the inner circumferential face of the fixing member.

7. The fixing device according to claim 1, wherein the laminated heater is attached to an inner circumferential face of the heater support.

8. The fixing device according to claim 7, further comprising:

a retainer to support the laminated heater between the inner circumferential face of the heater support and the retainer and fix the laminated heater on the inner circumferential face of the heater support.

9. An image forming apparatus, comprising the fixing device according to claim 1.

* * * * *